US007365712B2

(12) United States Patent
Yi

(10) Patent No.: US 7,365,712 B2
(45) Date of Patent: Apr. 29, 2008

(54) PLASMA DISPLAY PANEL

(75) Inventor: Jeong-Doo Yi, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 585 days.

(21) Appl. No.: 11/077,113

(22) Filed: Mar. 11, 2005

(65) Prior Publication Data

US 2005/0200568 A1 Sep. 15, 2005

(30) Foreign Application Priority Data

Mar. 12, 2004 (KR) ..... 10-2004-0016811

(51) Int. Cl.
*H01J 17/49* (2006.01)
*G09G 3/10* (2006.01)
*G09G 3/28* (2006.01)

(52) U.S. Cl. ..... 345/67; 345/72; 315/169.1; 313/584

(58) Field of Classification Search ..... 345/60–100
See application file for complete search history.

(56) References Cited

U.S. PATENT DOCUMENTS 6,680,573 B1 * 1/2004 Kim et al. ..... 313/584
2006/0256044 A1 * 11/2006 Yamada ..... 345/67

* cited by examiner

*Primary Examiner*—David L. Lewis
(74) *Attorney, Agent, or Firm*—H.C. Park & Associates, PLC

(57) ABSTRACT

A plasma display panel including first and second substrates facing one another with a gap therebetween, address electrodes formed on the first substrate along a first direction, barrier ribs mounted in the gap and defining a plurality of discharge cells, first and second electrodes formed on the second substrate along a second direction, which is substantially perpendicular to the first direction, and third electrodes extending along the second direction between pairs of the first and second electrodes. Areas of the third electrodes vary according to the color of the discharge cell over which the third electrodes are formed.

19 Claims, 6 Drawing Sheets

PLASMA DISPLAY PANEL

CROSS REFERENCE TO RELATED APPLICATION

This application claims priority to and the benefit of Korean Patent Application No. 10-2004-0016811, filed on Mar. 12, 2004, which is hereby incorporated by reference for all purposes as if fully set forth herein.

BACKGROUND OF THE INVENTION

1. Field of the Invention

The present invention relates to a plasma display panel (PDP), and more particularly, to a PDP that minimizes differences in discharge voltages of discharge cells.

2. Description of the Background

Generally, a PDP is a next-generation flat panel display that utilizes gas discharge to display images. Anywhere from a few hundred thousand to a few million discharge cells may be formed in a matrix configuration within the PDP. Depending on discharge cell structure and driving voltage waveforms, the PDP may be classified as a direct current (DC) PDP or an alternating current (AC) PDP.

In a conventional surface discharge AC PDP, address electrodes, barrier ribs, and phosphor layers are formed on a rear substrate at areas corresponding to discharge cells, and display electrode pairs comprising a scan electrode and a sustain electrode are formed on a front substrate orthogonally to the address electrodes. A dielectric layer and a protection layer cover the display electrodes. A discharge as (typically an Ne—Xe compound gas) may be filled in the discharge cells.

The phosphor layers may be made of red, green, and blue phosphor materials, and they may be deposited in the red (R), green (G) and blue (B) discharge cells, respectively. The blue phosphor material is typically made of $BaMgAl_{10}O_{17}$:Eu (barium magnesium aluminate where Eu is centered about illumination), the green phosphor material is typically made of $Zn_2SiO_4$:Mn (zinc silicate where Mn is centered about illumination) and $BaAl_{12}O_{19}$:$YBO_3$:Tb, and the red phosphor material is typically made of $Y_{0.35}Gd_{0.35}BO_3$ (yttrium gadolinium borate where Eu is centered about illumination), $Y_2O_3$:Eu, and $Gd_2O_3$:Eu.

Generally, the PDP displays images using a gas discharge to emit vacuum ultraviolet (UV) rays, which excite the phosphor layers to emit visible light. Color images may be obtained by selectively performing this operation.

Forming the phosphor layers using different materials for the different colors as described above may develop variations in a discharge voltage margin for the different colored phosphor layers. Consequently, a discharge voltage that is an average of the different discharge voltages required must be used. Further, since the phosphor layers may exhibit dissimilar illumination efficiencies according to the type of discharge gas used and discharge voltage conditions, any limitations put on the discharge voltage may adversely affect overall performance.

Accordingly, there is a need for a configuration that minimizes variations in discharge voltage margins, thereby allowing for the selection of discharge voltages over a large range.

SUMMARY OF THE INVENTION

The present invention provides a PDP that may reduce differences in firing voltages for different colored discharge cells, thereby increasing the overall range of a voltage that may used for the firing voltage.

Additional features of the invention will be set forth in the description which follows, and in part will be apparent from the description, or may be learned by practice of the invention.

The present invention discloses a PDP including a first substrate and a second substrate facing one another with a gap therebetween, address electrodes formed on the first substrate along a first direction, and barrier ribs arranged in the gap and defining a plurality of discharge cells. First and second electrodes are formed on the second substrate along a second direction, which is substantially perpendicular to the first direction. A third electrode if formed on the second substrate and extends along the second direction and is located between the first electrode and the second electrodes. A discharge cell comprises the first electrode, the second electrode, and the third electrode. A configuration of the third electrodes varies according to a color of the discharge cell.

The present invention also discloses a PDP including a first substrate and a second substrate facing one another with a gap therebetween, address electrodes formed on the first substrate along a first direction, and barrier ribs mounted in the gap and defining a plurality of discharge cells. A first and second electrode are formed on the second substrate along a second direction, which is substantially perpendicular to the first direction. A third electrode extends along the second direction and in between the first electrode and the second electrode. The first electrode and the second electrode are positioned corresponding to adjacent rows of the discharge cells formed along the second direction. Areas of the third electrodes vary according to a color of the discharge cell over which the third electrode is formed, an area of the third electrodes being smallest where positioned overlapping a red discharge cell, largest where positioned overlapping a blue discharge cell, and between these extremes where positioned overlapping a green discharge cell.

The present invention also discloses a PDP including a first substrate and a second substrate facing one another with a gap therebetween, address electrodes formed on the first substrate along a first direction, and barrier ribs mounted in the gap and defining a plurality of discharge cells. Red, green, and blue phosphor layers are respectively deposited in discharge cells to form red, green, and blue discharge cells. A first and second electrode are formed on the second substrate along a second direction, which is substantially perpendicular to the first direction A third electrode extends along the second direction and in between the first electrode and the second electrode. The first electrode and the second electrode are positioned corresponding to adjacent rows of the discharge cells formed along the second direction. An area of the third electrode is smallest where positioned over discharge cells having phosphor layers of a color having a largest discharge voltage margin, largest where positioned over discharge cells having phosphor layers of a color having a smallest discharge voltage margin, and between these extremes where positioned over discharge cells having phosphor layers of a color with a middle level discharge voltage margin.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

Figure 1:
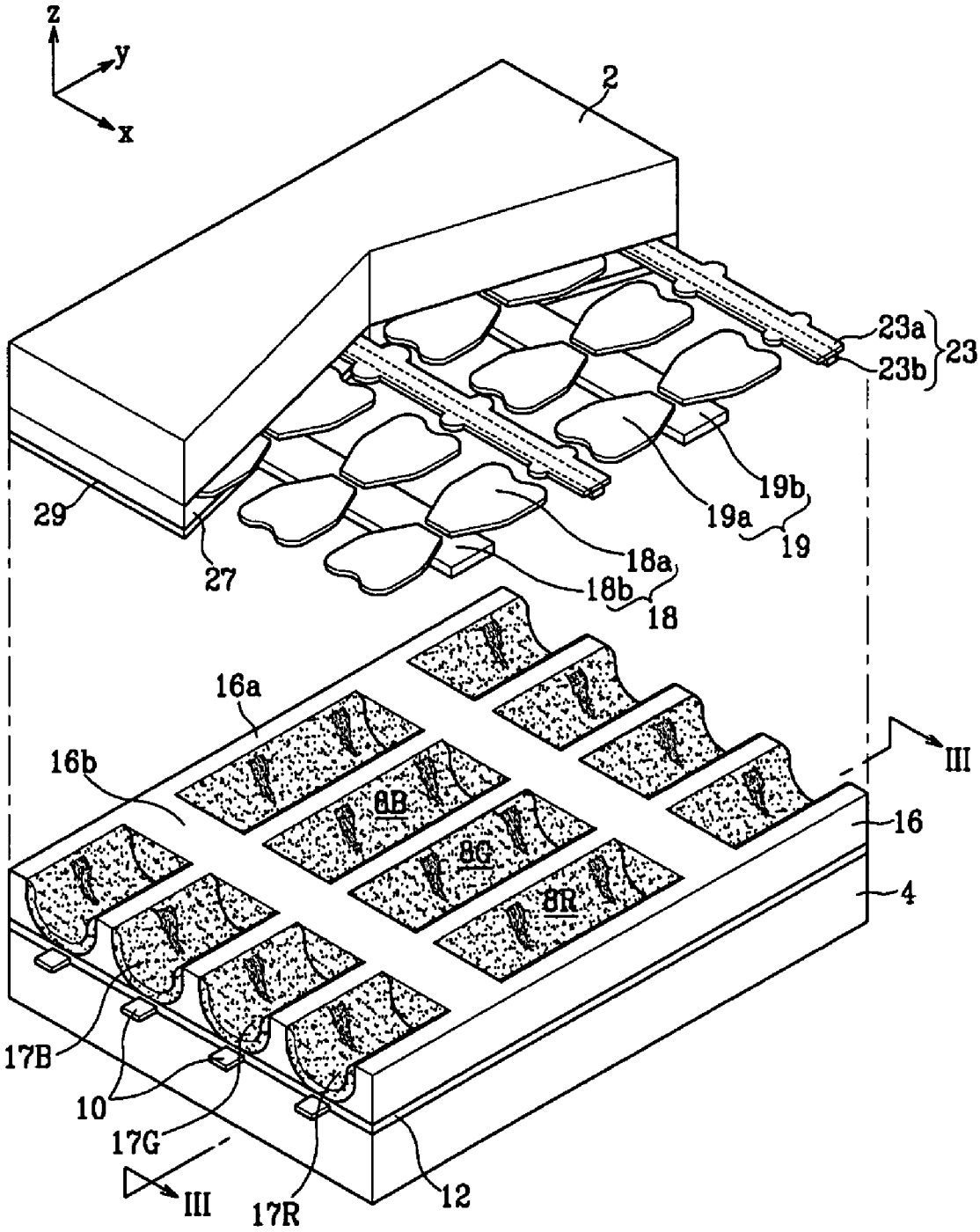
FIG. 1 is a partial exploded perspective view showing a PDP according to an exemplary embodiment of the present invention.
Figure 2:
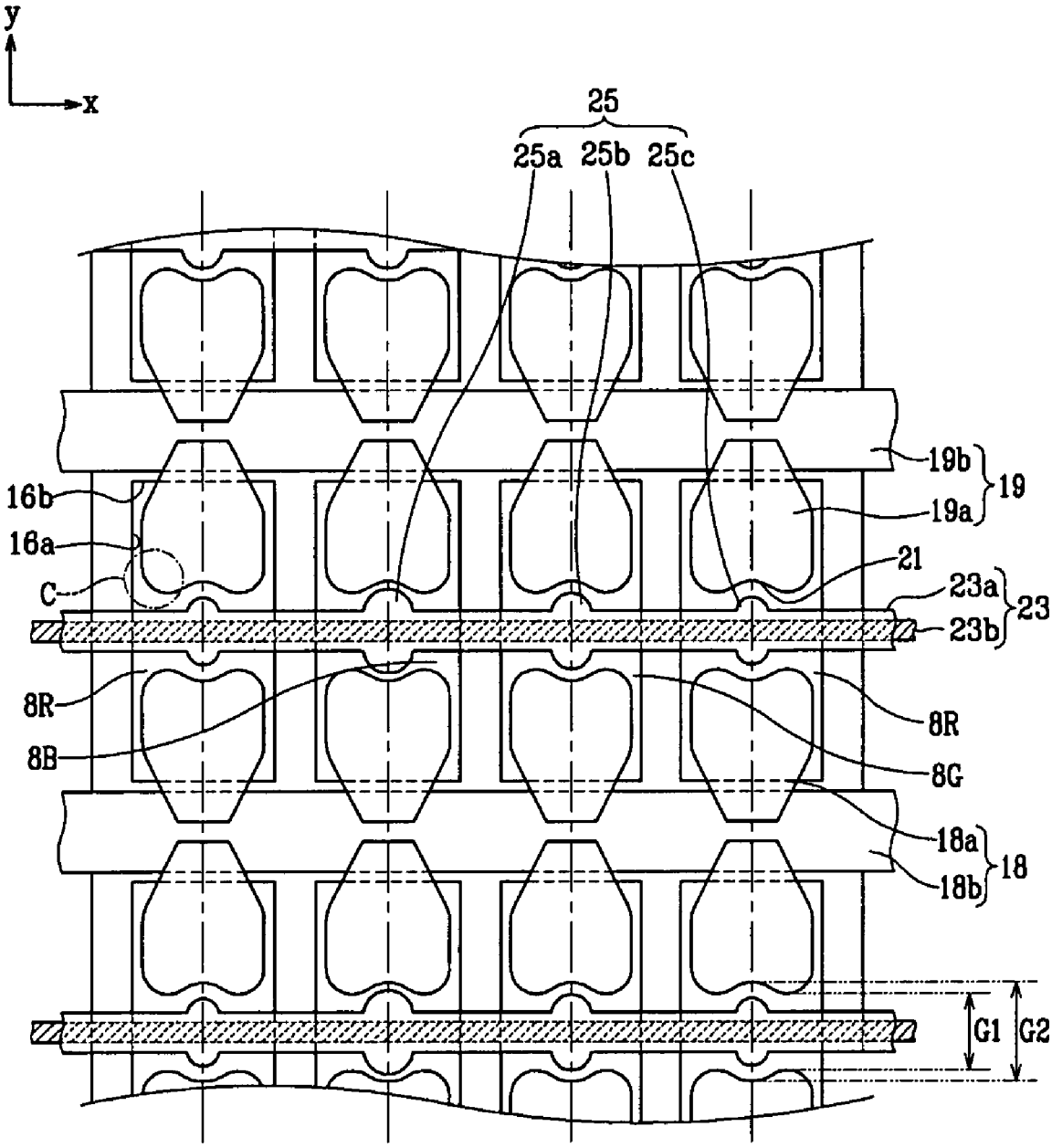
FIG. 2 is a partial plan view showing the PDP of FIG. 1 in an assembled state.
Figure 3:
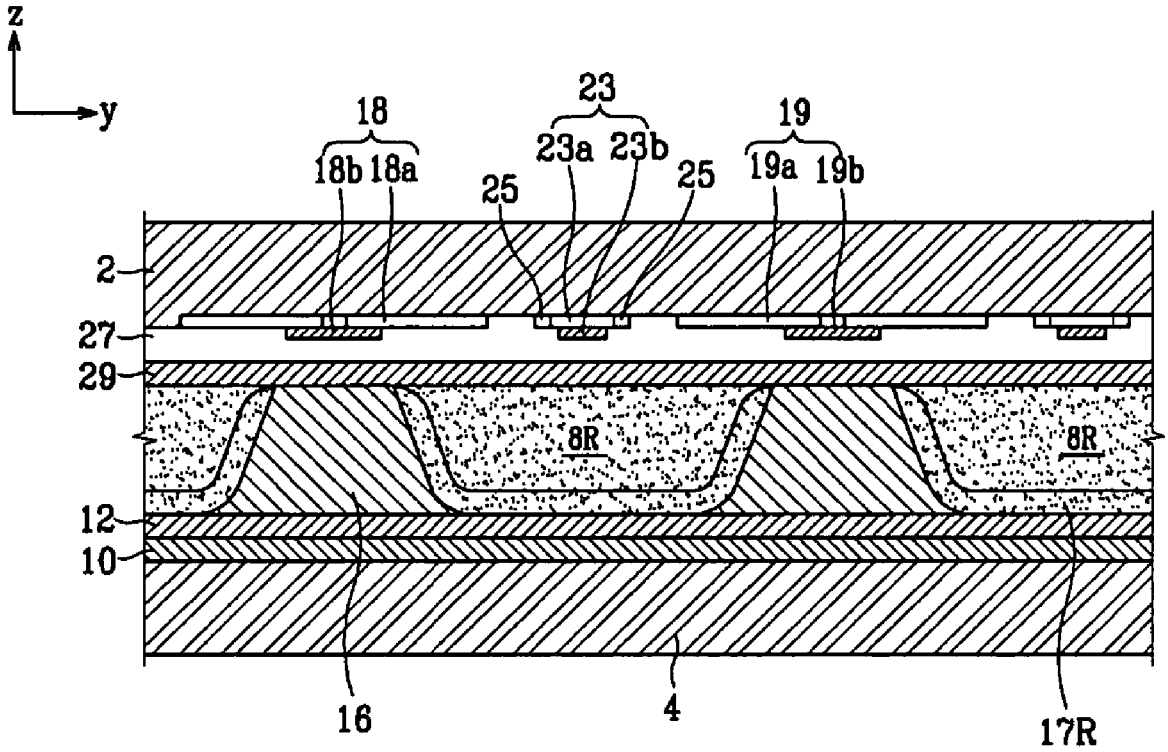
FIG. 3 is a sectional view taken along line III-III of FIG. 1, in which the PDP is shown in an assembled state.

FIG. 1 is a partial exploded perspective view showing a PDP according to an exemplary embodiment of the present invention, and FIG. 2 and FIG. 3 are a partial plan view showing the PDP of FIG. 1 and a sectional view taken along line III-III of FIG. 1, respectively.

Referring to FIG. 1, FIG. 2 and FIG. 3, the PDP may include a first substrate 2 and a second substrate 4 facing one another with a gap therebetween, and a plurality of discharge cells 8R, 8G, 8B defined by barrier ribs 16 in the gap.

Address electrodes 10 may be formed on an inner surface of the second substrate 4 along a first direction (i.e., along direction y in the drawings), and a first dielectric layer 12 may cover the address electrodes 10. The address electrodes 10 may be arranged such that they substantially correspond to centers of widths of the discharge cells 8R, 8G, 8B, where the widths are along direction x.

The barrier ribs 16 may be formed on the first dielectric layer 12 to define the discharge cells 8R, 8G, 8B, and red, green, and blue phosphor layers 17R, 17G, 17B may be formed in the discharge cells 8R, 8G, 8B, respectively.

In the exemplary embodiment shown in FIG. 1, the barrier ribs 16 include first barrier rib members 16*a* extending along the first direction y, and second barrier rib members 16*b* extending along a second direction (i.e., direction x in the drawings) and intersecting the first barrier rib members 16*a*. Consequently, the barrier ribs 16 form a lattice pattern, thereby defining the discharge cells 8R, 8G, 8B in a closed, or matrix, configuration. However, the present invention is not limited to this structure, and the barrier ribs 16 may be formed in other configurations, such as a stripe pattern.

Red, green, and blue phosphor materials may be deposited in the discharge cells 8R, 8G, 8B, respectively, to thereby form the phosphor layers 17R, 17G, 17B. Vacuum UV rays generated by plasma discharge strike the phosphor layers 17R, 17G, 17B to excite the same to emit visible light from the discharge cells. The phosphor materials may be different from each other. As an example, yttrium gadolinium borate ($Y_{0.35}Gd_{0.35}BO_3$) may be used for the red phosphor material, zinc silicate ($Zn_2SiO_4$) may be used for the green phosphor material, and barium magnesium aluminate ($BaMgAl_{10}O_{17}$) may be used for the blue phosphor material.

However, using different phosphor materials for the different colors may result in different required discharge voltages, and hence variations in a discharge voltage margin according to color. The discharge voltage margins may be defined as ranges of the discharge voltages at which discharge may be initiated (i.e., firing voltages) for the different colored discharge cells 8R, 8G, 8B. Accordingly, when driving a PDP having different discharge voltage margins according to color, a common discharge voltage margin should be established. To alleviate this problem, third (M) electrodes 23 of varying areas (depending on which color discharge cell is overlapped) may be used. The M electrodes 23 will be described in more detail below.

First (X) electrodes 18 and second (Y) electrodes 19 may be formed on a surface of the first substrate 2 opposing the second substrate 4. The X and Y electrodes 18, 19 may alternate along direction y. The X electrodes 18 may include a bus electrode 18*b*, which extends along direction x at an area corresponding to a second barrier rib member 16*b* to overlap the same, and a plurality of protruding electrodes 18*a*, which extend from the bus electrode 18*b* along direction y such that pairs of the protruding electrodes 18*a* extend from opposite sides of the bus electrode 18*b* at predetermined intervals. Similarly, the Y electrodes 19 may include a bus electrode 19*b*, which extends along direction x at an area corresponding to a second barrier rib member 16*b* to overlap the same, and a plurality of protruding electrodes 19*a*, which extend from the bus electrode 19*b* along direction y such that pairs of the protruding electrodes 19*a* extend from opposite sides of the bus electrode 19*b* at predetermined intervals.

Along direction y, the bus electrodes 18*b*, 19*b* may be as wide as, or narrower than, the second barrier rib members 16*b*. The protruding electrodes 18*a*, 19*a* extend from the bus electrodes 18*b*, 19*b*, respectively, with one end attached to the same, and their other ends extend toward centers of the corresponding discharge cells 8R, 8G, 8B. With this structure, a pair of the protruding electrodes 18*a*, 19*a* (i.e. one protruding electrode 18*a* and one protruding electrode 19*a*) may be provided opposing one another at areas corresponding to each discharge cell 8R, 8G, 8B.

In the exemplary embodiment, a distal end of the protruding electrodes 18*a*, 19*a* may include an indentation 21 formed inwardly toward the corresponding bus electrode 18*b*, 19*b*. Therefore, a first gap G1 may be formed between an opposing pair of the protruding electrodes 18*a*, 19*a* at outermost areas on both sides of the indentations 21 (i.e., farthest from the corresponding bus electrodes 18*b*, 19*b*), while a second gap G2 may be formed at innermost areas of the indentations 21 (i.e., areas closest to the corresponding bus electrodes 18*b*, 19*b*). Consequently, the first gap G1 is shorter than the second gap G2.

Accordingly, when applying discharge voltages to the electrodes, plasma discharge may be initiated at the first gaps G1 where the discharge path is the shortest, after which the discharge diffuses toward the second gaps G2. Hence, the discharge may start from exterior areas of the discharge cells 8R, 8G, 8B and spread to centers thereof.

In the exemplary embodiment, the indentations 21 may be rounded, as may be the distal end portions of the protruding electrodes 18*a*, 19*a* on both sides of the indentations (i.e., corners C). Furthermore, the protruding electrodes 18*a*, 19*a* may have substantially the same size and shape.

The bus electrodes 18*b*, 19*b* may be made of a non-transparent conductive material, such as a chrome (Cr) and copper (Cu) alloy, silver (Ag), or other like substances. On the other hand, the protruding electrodes 18*a*, 19*a* may be made of a transparent material, such as indium tin oxide (ITO), so they do not block the light emitted from the discharge cells.

The X and Y electrodes 18, 19 receive a voltage required for discharge during a sustain interval. Since their operational characteristics vary depending on the voltage used to bias them, it may be necessary to limit this sustain discharge voltage.

In the exemplary embodiment, M electrodes 23 extend along direction x between an X and Y electrode pair. The M electrodes 23 may be used as surface discharge electrodes. Compared to the conventional triode structure, the M electrodes 23 increase the discharge pathways such that gas discharge may occur over a greater region within the discharge cells 8R, 8G, 8B. The M electrodes 23 may also receive a voltage during a reset and address interval. However, the function of the M electrodes 23 may vary according to biasing conditions, and the present invention is not limited in this respect.

The M electrodes 23 extend along direction x between X and Y electrode 18, 19 pairs and they may be substantially centered between the X and Y electrode pair. The M electrodes 23 may include projected sections 25 protruding outwardly at areas corresponding to, and toward, the indentations 21 of the protruding electrodes 18*a*, 19*a*. In this embodiment, the projected sections 25 are convex. Therefore, a male/female formation may exist between the projected sections 25 and the indentations 21. The projected sections 25 enable discharge to be more easily performed between the protruding electrodes 18*a*, 19*a*.

Additionally, the M electrodes 23 may comprise a transparent electrode 23*a* and a bus electrode 23*b*. The bus electrodes 23*b* may be stripe-shaped, while the transparent electrodes 23*a* may overlap the bus electrodes 23*b* and include the projected sections 25 as described above.

Furthermore, the projected sections 25 may have different sizes (i.e., different areas) depending on which of the discharge cells 8R, 8G, 8B they are located in. Typically, the discharge voltage margin is the largest for red phosphor material, then for green phosphor material, and is the smallest for blue phosphor material. Therefore, of the projected sections 25, first projected sections 25*a* may be the largest and located in areas corresponding to the blue discharge cells 8B, second projected sections 25*b* may be smaller than the first projected sections 25*a* and located in areas corresponding to the green discharge cells 8G, and third projected sections 25*c* may be the smallest and located in areas corresponding to the red discharge cells 8R.

This structure results in different sized gaps being formed between the M electrodes 23 and the X and Y electrodes 18, 19 according to color. That is, the gaps formed between the M electrodes 23 and the X and Y electrodes 18, 19 at areas corresponding to the red discharge cells 8R is the largest, the gaps formed between them at areas corresponding to the blue discharge cells 8B are the smallest, and the gaps formed between them at areas corresponding to the green discharge cells 8G are between these two extremes.

A second dielectric layer 27 and a protection layer 29 may be sequentially formed on the first substrate 2 to cover the X and Y electrodes 18, 19 and the M electrodes 23.

Figure 4:
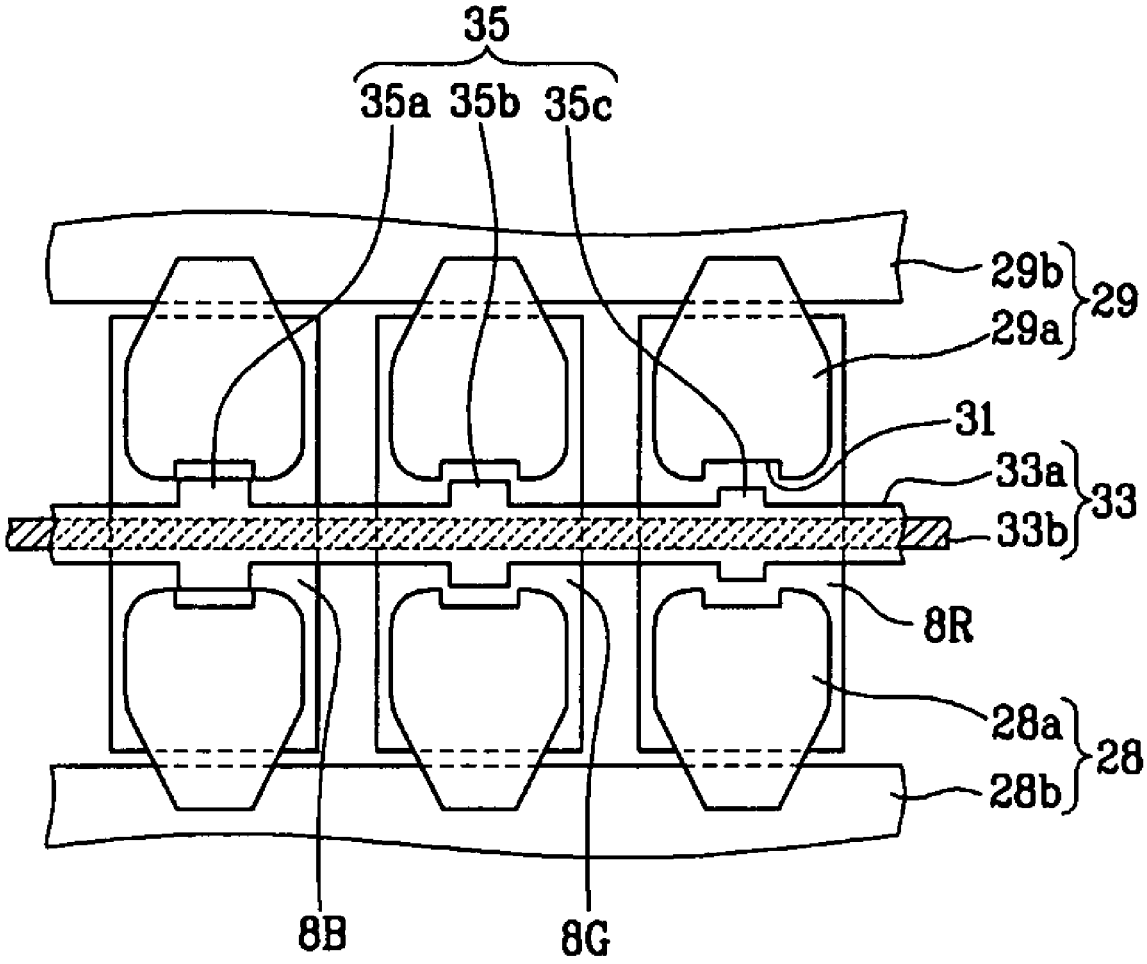
FIG. 4 is a partial plan view showing a PDP according to another exemplary embodiment of the present invention.

FIG. 4 is a partial plan view showing a PDP according to another exemplary embodiment of the present invention.

Referring to FIG. 4, the PDP of this exemplary embodiment may include M electrodes 33 comprising a transparent electrode 33*a* and a bus electrode 33*b*, as in the above exemplary embodiment. Further, the transparent electrodes 33*a* include a plurality of projected sections 35 formed at areas substantially corresponding to centers of discharge cells 8R, 8G, 8B. Additionally, of the projected sections 35, first projected sections 35*a* may be the largest and located in areas corresponding to the blue discharge cells 8B, second projected sections 35*b* may be smaller than the first projected sections 35*a* and located in areas corresponding to the green discharge cells 8G, and third projected sections 35*c* may be the smallest and located in areas corresponding to the red discharge cells 8R.

In this exemplary embodiment, however, the projected sections 35 are provided in an angled configuration. Similarly, indentations 31 of protruding electrodes 28*a*, 29*a*, which are coupled to the bus electrodes 28*b*, 29*b* of the X and Y electrodes 28, 29, have an angled configuration. As an example, the projected sections 35 and the indentations 31 may include two angles, and two of three sides thereof may be substantially the same length.

Figure 5:
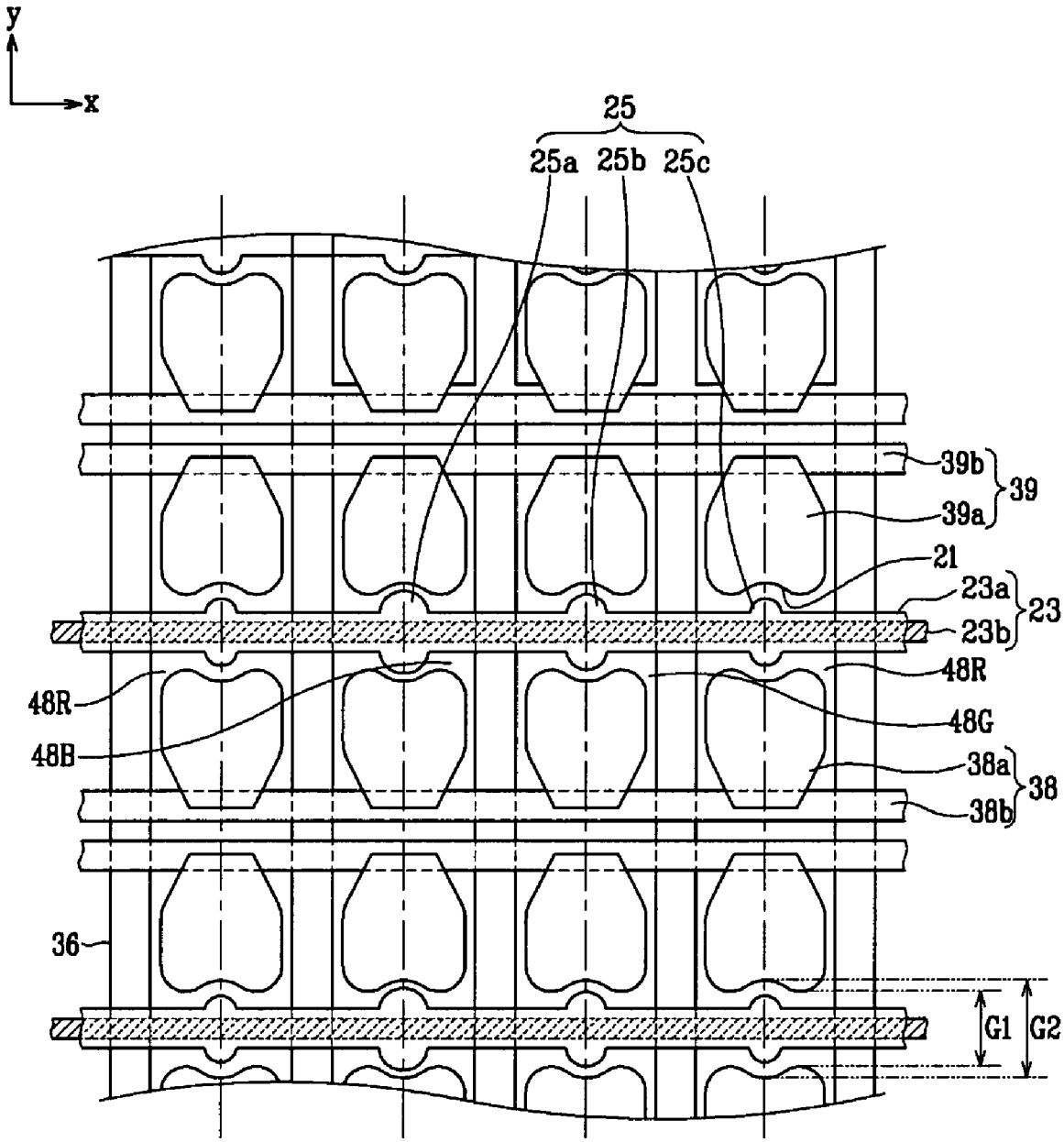
FIG. 5 is a partial plan view showing a PDP according to yet another exemplary embodiment of the present invention.

FIG. 5 is a partial plan view showing a PDP according to yet another exemplary embodiment of the present invention.

Referring to FIG. 5, the PDP according to this exemplary embodiment differs from the PDP of FIG. 1 at least in two respects. First, barrier ribs 36 may be formed in a stripe pattern extending along direction y, rather than in a lattice pattern. Second, pairs of bus electrodes 38*b* and of bus electrodes 39*b* of display electrodes 38, 39 may extend along direction x, adjacent to one another, and with a gap formed therebetween along direction y. Therefore, if "rows" of discharge cells 48R, 48G, 48B are formed along direction x, then a single bus electrode of the pairs of bus electrodes 38*b*, 39*b* is not shared between adjacent rows of the discharge cells 48R, 48G, 48B. Thus, different voltages may be supplied to the bus electrodes 38*b*, 39*b* of adjacent rows of the discharge cells 48R, 48G, 48B.

The PDP shown in FIG. 5 may be altered in the manner of the PDP described with reference to FIG. 4.

In exemplary embodiments of the present invention, including the third electrodes between the first and second electrodes, which effect sustain discharge, and operating the third electrodes together with the address electrodes to perform addressing may minimize non-discharge regions. Further, positioning the opaque bus electrodes over the barrier ribs, may minimize the level of blocked light, thereby improving illumination brightness. Also, during the display interval, making discharge between the display electrodes that form the long gaps during the main discharge may enhance discharge efficiency.

In exemplary embodiments of the present invention, areas of the third electrodes may vary according to the variations in the discharge voltage margins of the red, green, and blue discharge cells, thereby compensating for these differences in the discharge voltage margins. Consequently, the address voltage and the sustain discharge voltage may be adjusted, and operational margin characteristics may be improved.

Figure 6:
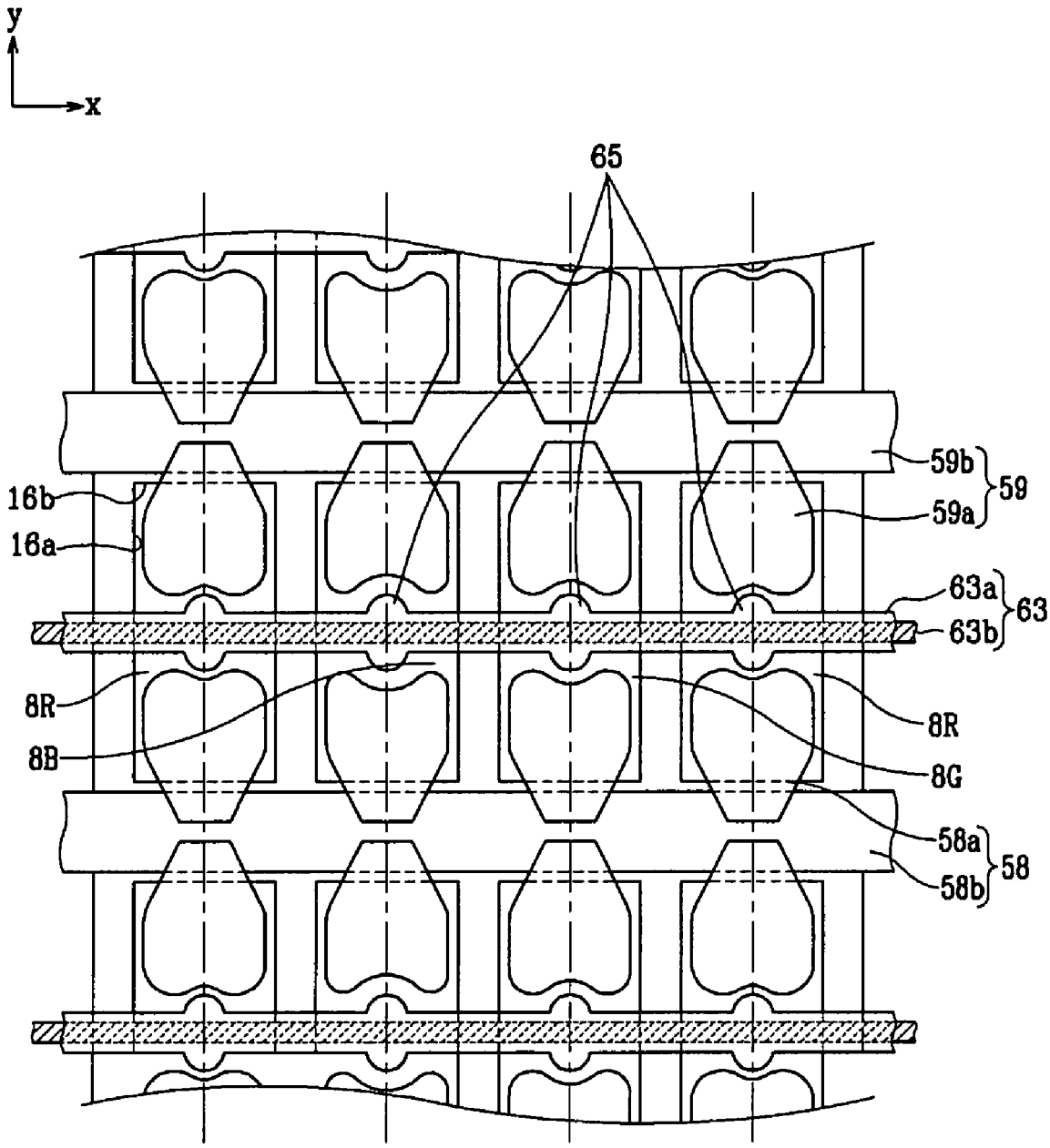
FIG. 6 is a partial plan view showing a PDP according to yet another exemplary embodiment of the present invention.

FIG. 6 is a partial plan view showing a PDP according to yet another exemplary embodiment of the present invention.

Referring to FIG. 6, the projected sections 65 on the M electrodes 63 may have an identical size and the indentations on the X and Y transparent electrode 58*a* and 59*a* may have different sizes depending on which of the discharge cells 8R, 8G, 8B they are located in.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a first substrate and a second substrate facing one another with a gap therebetween;

address electrodes formed on the first substrate along a first direction;

barrier ribs arranged in the gap to define a plurality of discharge cells;

a first electrode and a second electrode formed on the second substrate along a second direction, which is substantially perpendicular to the first direction; and a third electrode formed on the second substrate and extending along the second direction and located between the first electrode and the second electrode, wherein a discharge cell comprises the first electrode, the second electrode, and the third electrode; and wherein a configuration of the third electrode varies according to a color of the discharge cell.

2. The PDP of claim 1, wherein a gap between the third electrode and the first electrode, and a gap between the third electrode and the second electrode, varies according to the color of the discharge cell.

3. The PDP of claim 1, wherein the third electrode comprises a plurality of projected sections at locations corresponding to the plurality of discharge cells; and wherein an area of a projected section varies according to the color of the discharge cell.

4. The PDP of claim 1, wherein the third electrode comprises:

a bus electrode extending along the second direction, and a transparent electrode coupled to the bus electrode and wider than the bus electrode in the first direction, wherein a configuration of the transparent electrode varies according to the color of the discharge cell.

5. The PDP of claim 4, wherein the transparent electrode comprises a plurality of projected sections at locations corresponding to the plurality of discharge cells; and wherein an area of a projected section varies according to the color of the discharge cell.

6. The PDP of claim 5, wherein the projected sections are respectively positioned at locations corresponding substantially to centers of the discharge cells.

7. The PDP of claim 5, wherein the projected sections are convex; and wherein a projected section protrudes toward the first electrode and the second electrode.

8. The PDP of claim 5, wherein the projected sections are angled; and wherein a projected section protrudes toward the first electrode and the second electrode.

9. The PDP of claim 5, wherein the first electrode and the second electrode comprise:

a bus electrode extending along the second direction; and a plurality of protruding electrodes extending from the bus electrode toward centers of the discharge cells, and wherein a distal end of a protruding electrode is formed with an indentation opposing the projected section.

10. The PDP of claim 9, further comprising:

a gap between the projected section and the indentation, wherein a size of the gap varies according to the color of the discharge cell.

11. A plasma display panel (PDP), comprising:

a first substrate and a second substrate provided facing one another with a gap therebetween;

address electrodes formed on the first substrate along a first direction;

barrier ribs mounted in the gap and defining a plurality of discharge cells;

a first electrode and a second electrode formed on the second substrate along a second direction, which is substantially perpendicular to the first direction; and a third electrode extending along the second direction and in between the first electrode and the second electrode, wherein the first electrode and the second electrode are positioned corresponding to adjacent rows of the discharge cells formed along the second direction;

wherein areas of the third electrode vary according to a color of a discharge cell over which the third electrode is formed;

wherein an area of the third electrode is smallest where positioned overlapping a red discharge cell;

wherein an area of the third electrode is largest where positioned overlapping a blue discharge cell; and wherein an area of the third electrode is greater than the smallest area and less than the largest area where positioned overlapping a green discharge cell.

12. The PDP of claim 11, wherein a gap between the third electrode and the first electrode and between the third electrode and the second electrode is largest in the red discharge cell, slightly smaller in the green discharge cell, and smallest in the blue discharge cell.

13. The PDP of claim 11, wherein the third electrode comprises a plurality of projected sections at locations corresponding to the discharge cells, wherein an area of a projected section is smallest where positioned overlapping the red discharge cell, largest where positioned overlapping the blue discharge cell, and between these extremes where positioned overlapping the green discharge cell.

14. A plasma display panel (PDP), comprising:

a first substrate and a second substrate facing one another with a gap therebetween;

address electrodes formed on the first substrate along a first direction;

barrier ribs mounted in the gap and defining a plurality of discharge cells;

a red phosphor layer, a green phosphor layer, and a blue phosphor layer respectively deposited in discharge cells to form red discharge cells, green discharge cells, and blue discharge cells;

a first electrode and a second electrode formed on the second substrate along a second direction, which is substantially perpendicular to the first direction; and a third electrode extending along the second direction and in between the first electrode and the second electrode, wherein the first electrode and the second electrode are positioned corresponding to adjacent rows of the discharge cells formed along the second direction;

wherein an area of the third electrode is smallest where positioned over discharge cells having phosphor layers of a color having a largest discharge voltage margin;

wherein an area of the third electrode is largest where positioned over discharge cells having phosphor layers of a color having a smallest discharge voltage margin; and wherein an area of the third electrode is greater than the smallest area and less than the largest area where positioned over discharge cells having phosphor layers of a color with a middle level discharge voltage margin.

15. The PDP of claim 14, wherein a gap between the third electrode and the first electrode and between the third electrode and the second electrode, is smallest in the discharge cells having the phosphor layers of the color having the largest discharge voltage margin, largest where positioned over the discharge cells having the phosphor layers of the color having the smallest discharge voltage margin, and between these extremes where positioned over the discharge cells having the phosphor layers of the color with the middle level discharge voltage margin.

16. The PDP of claim 14, wherein the third electrode comprises a plurality of projected sections at locations corresponding to the discharge cells, wherein an area of a projected section is largest where positioned over the discharge cells having the phosphor layers of the color having the largest discharge voltage margin, smallest where positioned over the discharge cells having the phosphor layers of the color having the smallest discharge voltage margin, and between these extremes where positioned over the discharge cells having the phosphor layers of the color with the middle level discharge voltage margin.

17. A plasma display panel (PDP), comprising:

a substrate;

a plurality of discharge cells; and a first electrode, a second electrode, and a third electrode formed on the substrate and extending in a same direction;

wherein the third electrode is interposed between the first electrode and the second electrode;

wherein a discharge cell comprises the first electrode, the second electrode, and the third electrode; and wherein a configuration of the first electrode, the second electrode, and the third electrode varies according to a color of a discharge cell.

18. The PDP of claim 17, wherein the first electrode and the second electrode comprise:

a bus electrode extending along the second direction, and a plurality of protruding electrodes and extending from the bus electrode toward centers of the discharge cells;

wherein the third electrode comprises:

a bus electrode extending along the second direction, and a plurality of projected sections coupled to the bus electrode and at locations corresponding to the plurality of discharge cells;

wherein a distal end of a protruding electrode is formed with an indentation opposing a projected section; and wherein a size of the indentation varies according to the color of the discharge cell.

19. The PDP of claim 17, wherein the first electrode and the second electrode comprise:

a bus electrode extending along the second direction, and a plurality of protruding electrodes and extending from the bus electrode toward centers of the discharge cells;

wherein the third electrode comprises:

a bus electrode extending along the second direction, and a plurality of projected sections coupled to the bus electrode and at locations corresponding to the plurality of discharge cells;

wherein a distal end of a protruding electrode is formed with an indentation opposing a projected section; and wherein a size of the projected section varies according to the color of the discharge cell.

* * * * *